United States Patent [19]

Weidler

[11] 4,405,193

[45] Sep. 20, 1983

[54] PRELOADED ELECTRICAL CONNECTOR

[75] Inventor: Charles H. Weidler, Lancaster, Pa.

[73] Assignee: AMP Incorporated, Harrisburg, Pa.

[21] Appl. No.: 271,491

[22] Filed: Jun. 8, 1981

[51] Int. Cl.[3] ..... H01R 4/24

[52] U.S. Cl. ..... 339/99 R; 339/97 P

[58] Field of Search ..... 339/97 R, 97 P, 98, 339/99 R, 103 M, 105

[56] References Cited

U.S. PATENT DOCUMENTS

| | | | |
|---|---|---|---|
| 3,858,159 | 12/1974 | Worth | 339/105 |
| 3,985,416 | 10/1976 | Dola et al. | 339/98 |
| 4,053,197 | 10/1977 | Teagno | 339/99 R |
| 4,111,512 | 9/1978 | Parmer et al. | 339/105 |
| 4,159,158 | 6/1979 | Weidler | 339/97 P |
| 4,160,574 | 7/1979 | DeRoss | 339/99 R |
| 4,175,818 | 11/1979 | Kourimsky et al. | 339/176 MP |
| 4,317,608 | 3/1982 | Dechelette | 339/99 R |

*Primary Examiner*—John McQuade

*Attorney, Agent, or Firm*—Frederick W. Raring

[57] ABSTRACT pg,1 An electrical connector assembly comprises an insulating housing containing contact terminals and a conductor retaining plug member which is dimensioned to be fitted into the conductor entry face of the housing. The terminals have conductor connecting portion in the form of slots which extend inwardly in the terminals from the ends of the terminals that are adjacent to the conductor entry face. The conductor retaining plug member has retaining portions which are received in the slots in the terminals when the plug member is inserted. The plug member is provided with recesses on its sides through which the conductors extend when the plug member is fully inserted so that the conductors extend normally from the conductor entry face.

3 Claims, 7 Drawing Figures

Fig. 1
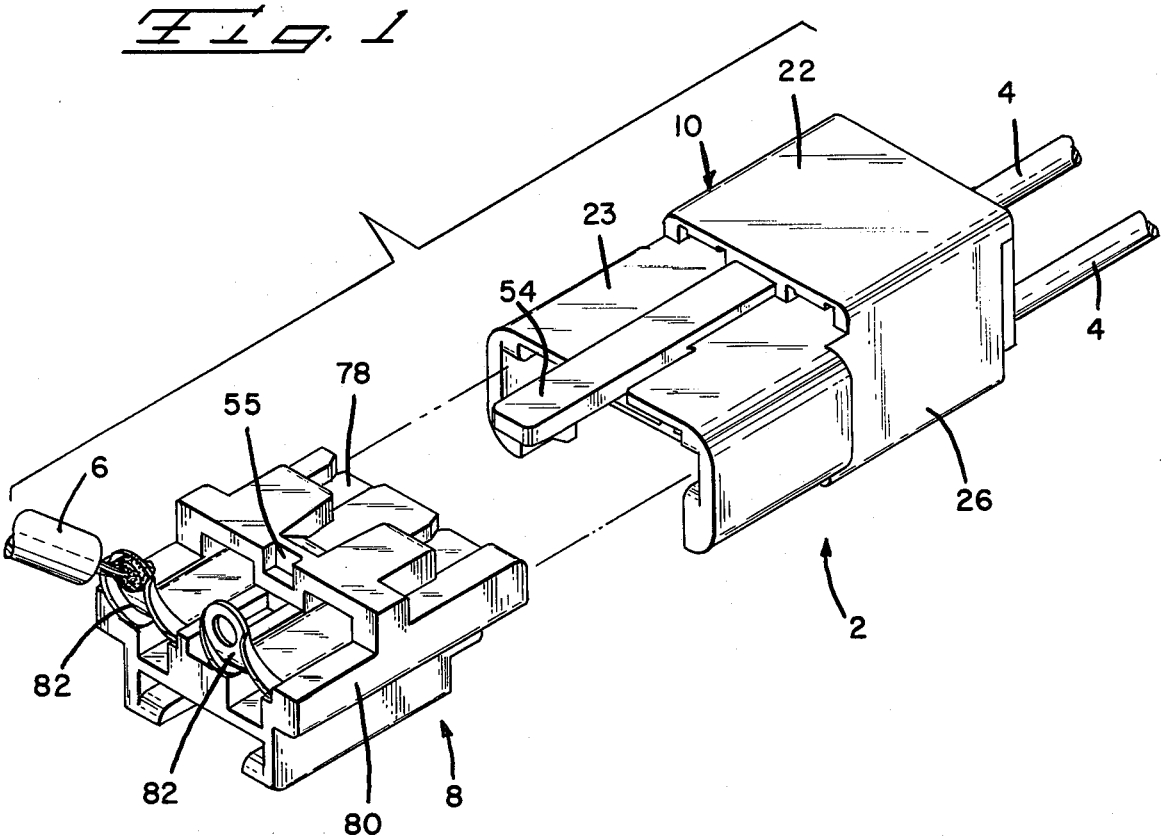
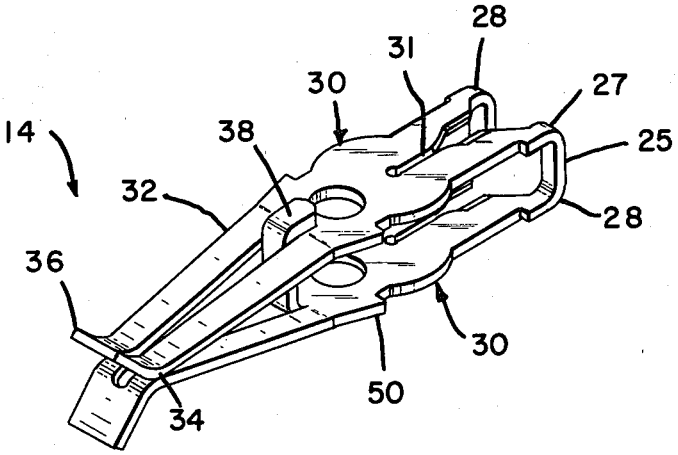
Fig. 3

PRELOADED ELECTRICAL CONNECTOR

FIELD OF THE INVENTION

This invention relates to electrical connectors of the type having terminals therein which are provided with conductor receiving slots. The invention is particularly related to improvements to such connectors which ensure complete insertion of the conductors into the slots and retention of the conductors in the slots when the connector is placed in service.

BACKGROUND OF THE INVENTION

U.S. Pat. No. 4,159,158 describes a widely used type of electrical connector comprising an insulating housing having contact terminals therein. Each terminal comprises an elongated strip of sheet metal which has been folded midway between its ends to form side-by-side contact arms. A wire receiving slot is provided in the terminal which extends inwardly from the fold so that when a conductor is inserted into the slot, the axis of the conductor will extend normally of the axis of the terminal. The conductor receiving slot in the terminal has its open end directed towards the rearward face of the connector housing and the conductor, therefore, extends laterally from the housing through one of the housing sidewalls rather than through the rearward face of the housing, as is usually preferable. The present invention in accordance with one aspect thereof is directed to the achievement of a connector having many of the desirable features of connectors of the type shown in the above identified U.S. Patent and which is so constructed that the conductors extend directly from the rearward face of the housing rather than laterally through one of the housing sidewalls.

It is important that any connector be such that the conductor will remain connected to the terminal when the connector is placed in service and it is also important that a strain relief means of some type be provided on the conductor so that when a tensile force is imposed on the conductor, the force will not be transmitted to the electrical connection between the conductor and the terminal.

The present invention in accordance with a further aspect is directed to the achievement of a connector having improved means for ensuring that the conductor will remain electrically connected to the terminal and that tensile forces imposed on the conductor will not affect the electrical connection between the conductor and the terminal.

A preferred embodiment of the invention comprises a connector assembly consisting of an insulating housing, contact terminals in the housing, and a conductor retaining plug member which is dimensioned to be inserted into the conductor entry face of the housing. The terminals have conductor connecting portions which comprise wire receiving slots, the open ends of which are directed towards the conductor entry face of the housing so that the end portions of wires, or other conductors which have been inserted into these slots, extend laterally with respect to the axes of the terminals. The retaining plug which is fitted into the housing has retaining projections that are dimensioned to enter the conductor receiving slots in the terminals so that when the plug is fully inserted into the housing, these retaining portions prevent disengagement of the conductors from the terminals. Recesses are provided between the retaining plug and the internal surfaces of the housing and the conductors are dressed laterally within the housing so that they extend through these recesses. The recesses extend to the conductor entry face of the housing and the conductors as a result emerge from the housing with their axes extending normally of the conductor entry face and parallel to the axis of the connector.

DESCRIPTION OF THE DRAWINGS

FIG. 1 is a perspective view of a connector assembly in accordance with the invention in alignment with a complementary connector.

FIG. 3 is a perspective view of an individual electrical terminal of the type intended for use in the housing.

PREFERRED EMBODIMENT OF THE INVENTION

Figure 2:
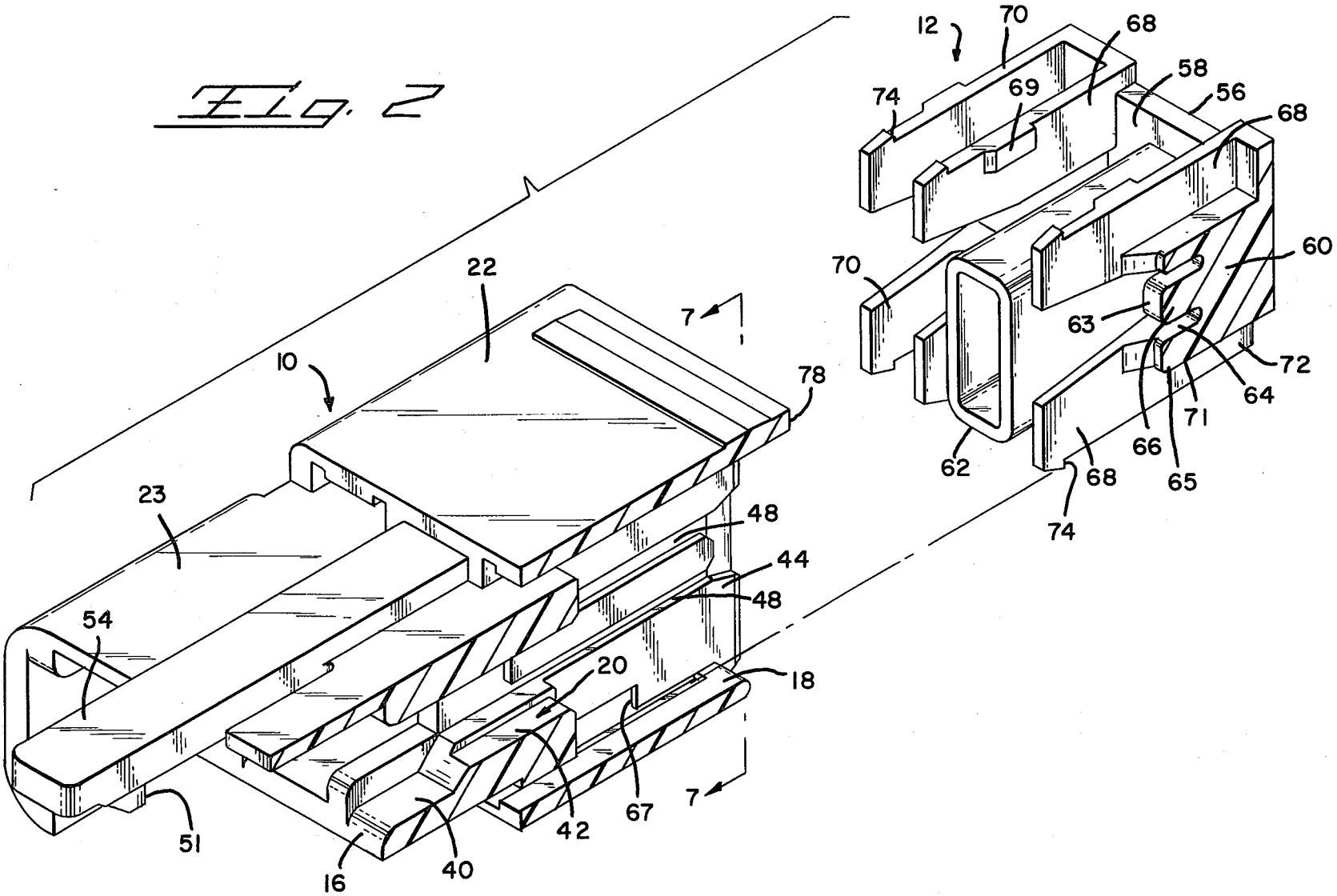
FIG. 2 is a perspective view partially in section, showing the connector housing and the conductor retaining plug exploded from the wire entry face of the housing.

A connector assembly 2, FIG. 1, in accordance with the invention, serves to connect conductors 4 which extend to the assembly 2 to conductors 6 which extend to a complementary connecting device 8. The connector assembly 2 comprises a housing 10, which contains terminals 14, and a retaining plug 12, see FIGS. 2 and 3.

The housing 10 is molded of suitable thermoplastic material and has a mating face 16, a conductor entry face 18, and a plurality of terminal receiving cavities 20 which extend through the housing and between the two oppositely directed faces. The housing has upper and lower sidewalls 22, 24 and oppositely facing endwalls 26. The upper sidewall has an extension 23 from which there projects a latch arm 54 which is received by a suitable latching shoulder 55 on the complementary connecting device 8.

Each of the terminals 14 comprises an elongated strip of conductive sheet metal which has been folded midway between its ends as shown at 27, 28, to form a pair of coextensive arms 30. The forward portions 32 of these arms converge so that the contact zones 34 on the opposed surfaces of the arms are normally against each other. The end portions of the arms diverge as shown at 36, to provide guiding surfaces for the terminal blades 78 in the complementary connector 8. The terminal disclosed in FIG. 3 has a brace 38 struck from the lower arm and clinched to the upper arm, as viewed in FIG. 3. This brace controls the behavior of the end portions 32 of the arms 30 when a contact blade 78 is moved between the contact surfaces 34 of the arms.

Each of the cavities 20 in the connector housing 10 has a somewhat enlarged forward portion 40 adjacent to the mating face 16 in which the end portions of the arms are located. The intermediate portion 42 of each cavity is somewhat constricted and receives intermediate portions of a terminal. The side edges of the terminals have barbs 50, which penetrate the internal walls of the cavities to retain the terminals in the cavities. The portions of each cavity which are adjacent to the conductor entry face 18 are enlarged as shown at 44, and the conductor connecting portions of the terminal 14, including the wire receiving slots 31, are received in these enlarged portions of the cavity. As best shown in FIG. 2, the opposed cavity walls which extend vertically in FIG. 2, are provided with parallel slots 48 at the conductor entry side of the housing and these slots receive edge portions of the arms 30 of the terminals, as described more fully in the above identified U.S. Pat. No. 4,159,158.

Figure 7:
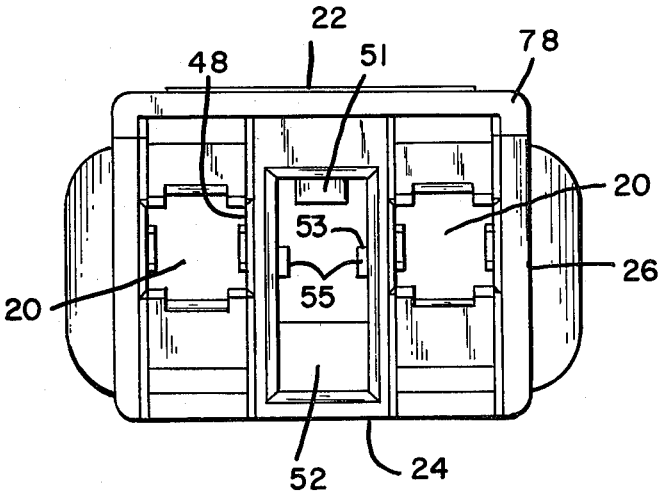
FIG. 7 is a view looking in the direction of the arrow 7—7 of FIG. 2 of the conductor entry face of the connector housing.

As shown in FIG. 7, the two cavities 20 in the embodiment of the invention shown are separated by an enlarged opening 52 which also extends completely through the housing from the conductor entry face to the mating face. In the disclosed embodiment, this opening is provided to facilitate the manufacturing of the housing by an injection molding process. The opening 52 permits the use of a core pin which will form the rearwardly facing shoulder 51 on the underside of the previously described latch arm 54. Ribs 53 are provided on the opposed sidewalls of the opening 52. The ends 55 of these ribs are spaced inwardly from the conductor entry face 18.

Figure 6:
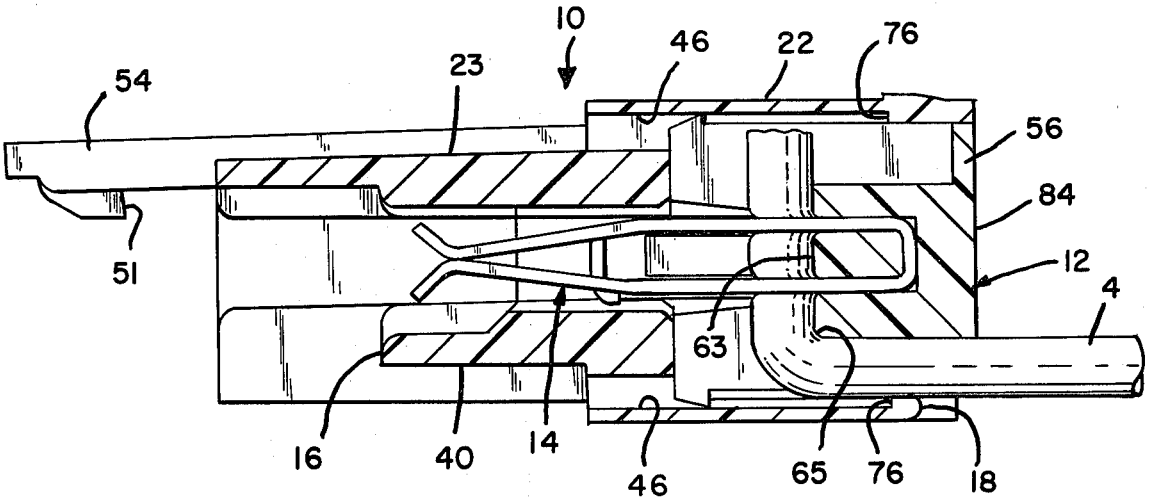
FIG. 6 is a view similar to FIG. 5 but showing the conductor extending into the housing and connected to the terminal and showing the retaining plug in its fully inserted position.

The plug 12 comprises a platelike section 56 which is dimensioned to be fitted into the open wire entry face 18 of the housing and which has on its internal surface 58 retaining projections 60, one projection 60 being provided for each of the cavities 20. A central projection 62 also extends from surface 58, this projection having a rectangular cross-section and being dimensioned to enter the opening 52. The retaining projections 60 have parallel spaced-apart recesses 64 extending inwardly from the leading end 63 of the projection and these recesses receive the end portions of the terminal 14 located in the associated cavity of the housing. The portion 66 of the retaining projection 60 which is between the recesses 64 is dimensioned to enter the terminal between the connecting straps 25 which are on each side of the conductor received slot 32. As shown in FIG. 6, this central section 66 bears against the insulation of the conductor when the conductor is in the slot and the plug member is fully inserted into the housing.

Guide bars 70 extend from the internal surface 58 of the platelike section 60 at the corners thereof and additional guide bars 68 extend from surface 58 which are spaced inwardly from the guide bars 70; guide bars are thus provided on each side of each of the retaining projections 60. The guide bars have edges which bear against the internal upper and lower surfaces 46 of the housing adjacent to the conductor entry face 18 and serve to guide the plug member accurately into the housing. Additional guiding is achieved by the central projection 62 which enters the opening 52.

Figure 5:
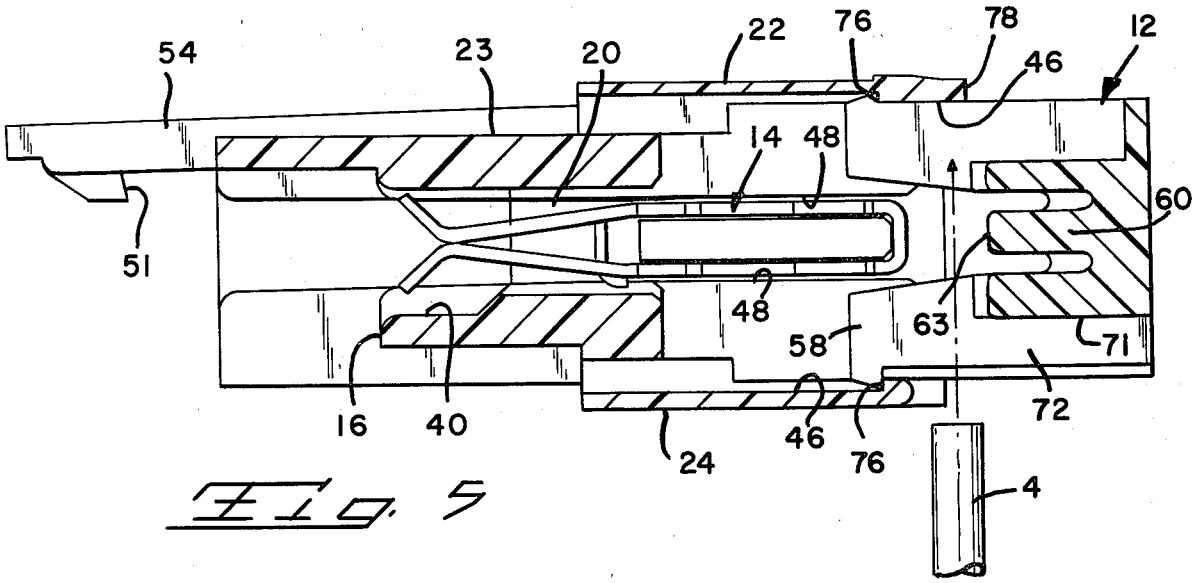
FIG. 5 is a sectional side view of the connector with the retaining plug partially inserted into the housing.

A conductor receiving recess 72 is provided in each projection 60 between the lower surface 71 of the projection, see FIG. 2, and the lower internal surface 46 of the housing shown in FIG. 5. This recess is dimensioned to receive the conductor, as shown in FIG. 6, and when the conductor is positioned in the recess, it will be dressed around a relatively sharp corner 65 of the projection. The abrupt right angle bend in the conductor shown in FIG. 6, provides an effective strain relief in that a tensile pull applied to the conductor, shown in FIG. 6, will be transmitted to the plug member at the corner 65 and will not be transmitted to the end portion of the conductor which is located in the slots 32 of the terminal.

The guide bars have rearwardly facing shoulders 74 on their edges, which are cooperable with shoulders 76 in the housing that face forwardly of the housing and are adjacent to the rearward edge 78 of the housing at the conductor entry face. The plug member 12 can therefore be partially inserted into the housing as shown in FIG. 5, until the shoulders 74, 76 are in engagement with each other. When the plug member is in the partially inserted position of FIG. 5, the leading end of the projection 62 on the plug member 12 will be against the rearward ends 55 of the ribs 53 on the sidewalls of the opening 52. These ribs 53 serve as a stop for the plug 12 and prevent unintended insertion to the position of FIG. 6. When the parts are in this position, the conductor receiving end of the terminal 14 is spaced from the leading surface 63 of the projection 60 and the conductor can be inserted into the space between the terminals and the surface 63. The portion of the surface 46 of the upper sidewall 22 which is adjacent to edge 78, serves as a stop for the conductor.

Figure 4:
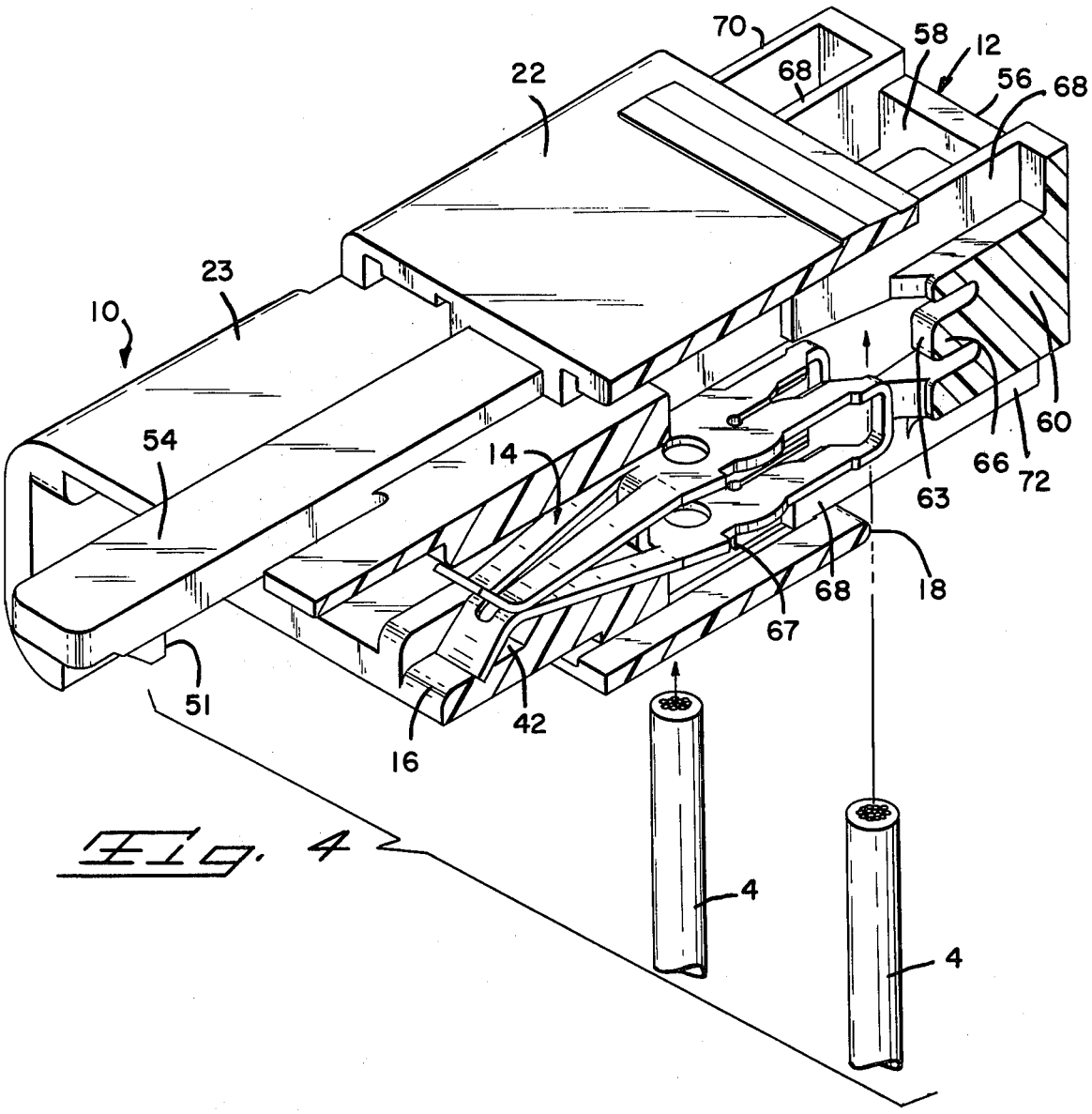
FIG. 4 is a view similar to FIG. 2, showing a terminal positioned in the housing cavity and the retaining plug partially inserted into the housing.

The wires 4 are connected to the terminals 14 in the connector by moving the wires upwardly from the positions shown in FIGS. 4 and 5 until the wires are against the internal surface 46 of the sidewall 22. Accurate guiding of the wires is achieved by the guide bars 68, 70 and the axis of the wire will be in alignment with the slot 32 of the associated terminal. The plug member 12 is then moved inwardly from the position of FIG. 5 to the position of FIG. 6 and the wire will be pushed into the wire receiving slot 32 when this step is carried out. At the same time, the wire will be dressed rightwardly, as viewed in the drawing, and located in the recess 72 so that after installation of the connector on the ends of the wires, the wires will extend normally of the external surface 84 of the plug member. Upon insertion of the plug 12 to the position of FIG. 6, the projection 60 must move past the ribs 53 and the walls of the projection collapse to permit this movement. The plug is retained in its fully inserted position of FIG. 6 by latching bosses 69 on the sides of the guide bars 68, 70. These bosses 69 are received in openings 67 in the sidewalls of the cavities 20.

When the plug member is fully inserted into the housing, a visual assurance is provided that the wires are connected to the terminals in the connector since the plug member cannot be fully inserted unless the wires are moved fully into the wire receiving slots in the terminals. Furthermore, the presence of the plug member assures that the electrical connections of the conductors to the terminals will remain secure so that the connector can perform its intended use.

The principles of the invention can be applied to a wide variety of particular connector shapes. The specific connector 2, shown in the drawing, is of a form used in the automotive industry and is designed to accept the complementary connector 8 which has spaced-apart blades that are received between the arms of the terminals 14. The blades 78 are contained in a molded support 80 and the rearward ends 82 of the blades in the embodiment shown are soldered to the conductor cores of the wires 6.

I claim:

1. An electrical connector assembly of the type comprising an insulating housing and a conductor retaining plug, said housing having a mating face, a conductor entry face, oppositely facing parallel sidewalls and oppositely facing parallel endwalls extending between said faces, at least one contact receiving cavity extending through said housing from said mating face to said conductor entry face, an electrical terminal in said cavity, said terminal having a conductor connecting portion which is proximate to said conductor entry face, said conductor connecting portion comprising at least one plate-like member which is parallel to said sidewalls, said plate-like member having a conductor-receiving slot having an open end which is directed towards said conductor entry face, said retaining plug being insertable into said housing at said conductor entry face and having retaining and conductor inserting projections thereon which are dimensioned to extend past said plate-like member and retain a conductor in said slot, said connector assembly being characterized in that:

said plug has spaced-apart parallel guide bars thereon extending beside, and beyond, said retaining and conductor inserting projections, said plug being partially inserted into said conductor entry face with said guide bars extending into the interior of said housing and with said retaining and conductor inserting portions spaced from said conductor connecting portion and spaced from said conductor entry face, said guide bars and internal surface portions of said cavity having opposed shoulders thereon serving to hold said plug in said partially inserted position, whereby upon positioning a conductor between said retaining projections and said plate like member and moving said retaining plug to its fully inserted position, said conductor will be moved into said slot by said retaining and conductor inserting projections.

2. An electrical connector assembly as set forth in claim 1 characterized in that the plug has a conductor-receiving recess on at least one side thereof which is opposed to one of said housing sidewalls, said conductor-receiving recess being dimensioned to receive a conductor extending from said conductor connecting portion upon full insertion of said plug into said housing whereby said conductor will extend axially from said conductor-entry face.

3. An electrical connector assembly as set forth in claim 2 characterized in that said housing has at least two conductor-receiving cavities extending therethrough, said plug having a retaining and conductor inserting projection for each of said cavities, each of said projections having two of said guide bars adjacent thereto with the projection being between the guide bars.

* * * * *